United States Patent [19]

Mitchell et al.

[11] 4,100,635

[45] Jul. 18, 1978

[54] WATER BED CONSTRUCTION

[76] Inventors: Michael W. Mitchell, 606 Esplanade, Redondo Beach, Calif. 90277; James C. Hauser, 26621 Westvale Rd., Palos Verdes, Calif. 90274

[21] Appl. No.: 764,388

[22] Filed: Jan. 31, 1977

[51] Int. Cl.[2] ..... A47C 27/08

[52] U.S. Cl. ..... 5/368; 5/349; 5/369; 5/371

[58] Field of Search ..... 5/365, 371, 349, 350

[56] References Cited

U.S. PATENT DOCUMENTS

| | | | |
|---|---|---|---|
| 3,426,373 | 2/1969 | Scott et al. | 5/369 |
| 3,766,579 | 10/1973 | Shields | 5/371 |
| 3,795,021 | 3/1974 | Moniot | 5/368 |
| 3,864,768 | 2/1975 | Fraige | 5/369 |

*Primary Examiner*—Casmir A. Nunberg
*Attorney, Agent, or Firm*—Mahoney, Schick & Cislo

[57] ABSTRACT

Improved water bed construction where, in one embodiment, two spaced inflatable members are positioned along the two lateral edges within a water bed frame with a separate water filled mattress being positional thereover with the conventional safety or water liner, wherein the inflatable members are filled with liquid or gas so as to have less resiliency than the water filled mattress portion, whereby ease of entry and exit onto the water mattress is facilitated. In another embodiment a liquid or gas supply means with appropriate controls is utilized so as to selectively and preferentially fill the lateral inflatable members to desired pressure, or alternately, to deflate same to selectively alter the resiliency thereof to facilitate supporting conditions of the water mattress.

8 Claims, 4 Drawing Figures

WATER BED CONSTRUCTION

BACKGROUND OF THE INVENTION

As water beds have become more commonplace and more and more people are experiencing the restful attributes associated with water beds, several undesirable characteristics associated with water beds have arisen. For example, in a conventional bed using box spring and mattress one can easily sit on the edge of the bed for a desired purpose and may easily enter and exit the bed by reason of the lateral edges being somewhat rigid.

In the case of the conventional water bed, it is difficult to enter and exit the bed because of the substantial resilience of the lateral edges and while the prior art has suggested the utilization of pneumatic or solid foam plastic members along two or more lateral edges, these members have been retained inside and within the water mattress per se. While this has helped alleviate the difficulties with regard to entering and exiting the water bed, nonetheless serious other drawbacks remain.

For example, the non-resilient lateral edges change the bouyancy characteristics of a water filled mattress and in the prior art, once obtained, the substantially more rigid edges remained during use of the water bed. Additionally, manufacturing techniques have been necessarily complex because of the fact that the support members were secured within the water mattress and one desiring to convert an existing water bed structure to one having reinforced lateral edges would incur great expense in having to discard an existing mattress.

With the herein described invention, a conventional water bed may be converted to one having substantially more resistant or less deformable lateral edges than the remainder of the bed and wherein, once situated on the water mattress, the relative hardness or softness of the edge portions may be selectively changed and/or controlled depending upon the desired end result. Additionally, because the reinforcement members of the invention are external of the water mattress, expensive manufacturing techniques are not necessary and further, servicing of the reinforcing members is easily obtained as opposed to prior art structures which would necessitate gaining access to the interior of the water mattress per se.

OBJECTS AND SUMMARY OF THE INVENTION

It is an object of the invention to provide an improved water bed structure.

It is another object of the invention to provide a water bed structure wherein at least two opposed lateral edges thereof are of less resilience than the reaminder or central portion of the water bed.

It is another important object of the invention to provide expansible or inflatable members for placement along two or more lateral edges of a water bed structure so as to convert existing water bed structures to those that have the ability to provide less resilient lateral edges for ease of entry and exit onto the water bed structure.

It is still another important object of the invention to provide a water bed structure wherein expansible or inflatable members are positioned along, for example, two lateral edges of the water bed structure and retained in place whereby the degree of expansion and/or inflation of the members is selectively controlled.

It is another important and specific object of the invention to provide a water bed structure utilizing a conventional water bed frame, liner and mattress wherein inflatable expansible members are positioned along two lateral edges and connected to a fluid or gas supply controlled through selective means for selectively increasing or decreasing the degree of expansion or inflation of the expansible or inflatable members.

It is another important and specific object of the invention to provide a means of converting existing water bed structures to those having substantially more rigid lateral edges for ease of entry and exit onto the water bed mattress and wherein the degree of resilience is selectively controlled.

In an exemplary embodiment the invention pertains to an improved water bed structure comprising the combination of a water bed frame having a four sided configuration and forming a compartment wherein a water proof liner lines the interior of the compartment and at least two spaced apart expansible or inflatable members are positioned along two opposite lateral edges of said compartment and adapted to selectively extend along the depth thereof and wherein a water mattress overlies said at least two inflatable expansible members and is retained within said compartment to complete a water bed structure having a plurality of attributes. In another embodiment of the invention a supply means having a liquid or gaseous supply with selective control means is interconnected to the expansible or inflatable means in order to selectively control the degree of resilience or rigidity of the expansible or inflatable members.

These and other objects of the invention will become apparent from the hereinafter following commentary taken in conjunction with the figures of drawing.

DESCRIPTION OF A PREFERRED EMBODIMENT

Figure 1:
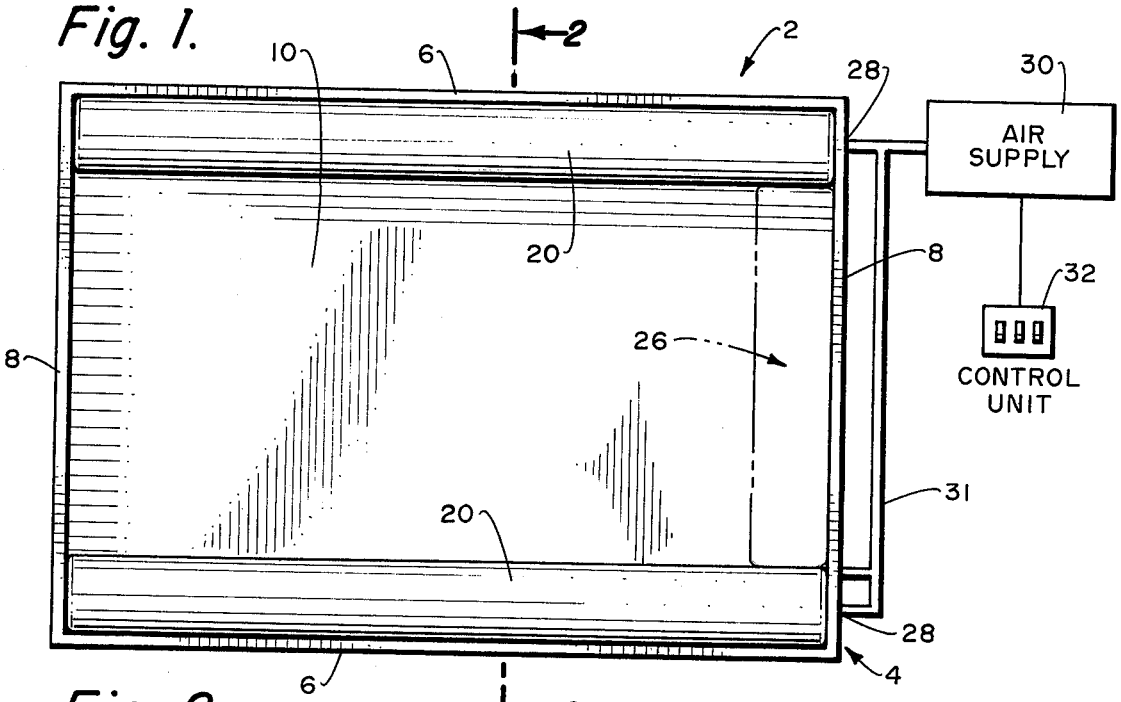
FIG. 1 is a top, partially schematic view of an improved water bed structure in accordance with the invention.

Referring to the figures of drawing wherein like numerals of reference designate like elements throughout, it will be seen that the water bed structure 2 comprises a conventional four sided water bed frame 4 having a rectangular configuration with long lateral sides 6 and short lateral sides 8. The frame 4 may be of wood or other materials of construction but is such so as to form a compartment 10 having a depth 12 dictated by the height of the members 6 and 8 making up the frame structure 4.

Figure 2:
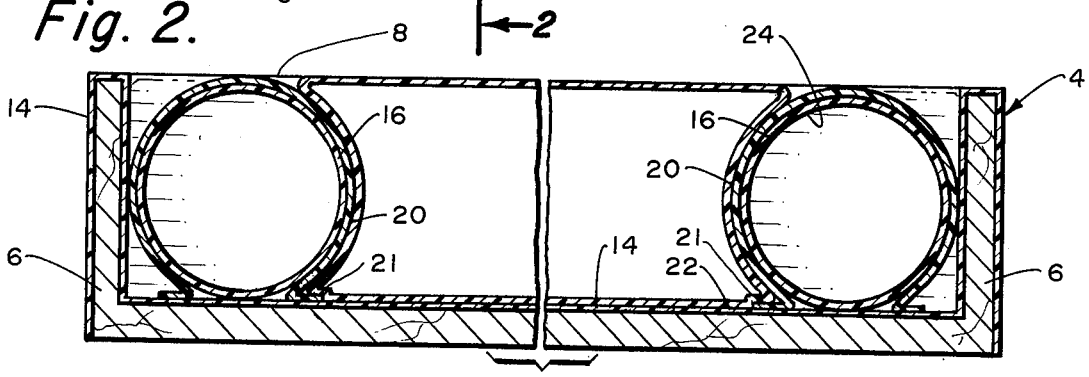
FIG. 2 is a view taken along the line 2—2 of FIG. 1.

Within the compartment 10 and as is conventionally found in water bed structures, a liner 14 is provided to line the interior of compartment 10 and may be brought to the exterior of lateral wall members 6 as illustrated in FIG. 2 and suitably secured in a manner well known in the art.

Thus far the described structure is conventional and if a conventional water mattress is positioned within the compartment 10 and filled with water, the usual water filled mattress bed would result. The conventional water bed would have non-rigid sides making it difficult to enter and exit the water bed, as well as other disadvantages which will become apparent.

In accordance with the practice of the invention, prior to the insertion of a water mattress into the compartment 10 there is positioned a cylindrically formed expansible or inflatable member 16 cylindrical in shape, if desired, and made of polyvinyl chloride or other plastic of economic feasibility, or where desired or elastomeric material of sufficient thickness to withstand the pressures of the fluid or gas being introduced thereinto. Where a relatively thin polyvinyl chloride plastic is utilized, it is desirable to have a reinforcing sleeve 18 of "Dacron", "Nylon" or suitable reinforcing material so as to enable the expansible or inflatable member 16 to withstand the pressures involved in use. Obviously, where thicker thicknesses of plastic, rubber or the like are utilized, the reinforcing sleeve 18 may be dispensed with.

Desirably, but not necessarily, a sheet segment or retainer of heat sealable plastic, for example, polyvinyl chloride may be utilized and the retainer 20 is omega-shaped in cross-section with the flanges 21 heat sealed along the under surfaces thereof to the upper surface 22 of liner 14. It is to be understood that the retainers 20 run substantially the distance of the lateral edge which is to be reinforced and in the particular instance illustrated along the long sides thereof and thus two sleeve-like cavities 24 are formed to receive the deflated or unfilled expansible members 16 which may be inserted into the sleeves for subsequent filling or inflation.

In some instances, where desired, an expansible or inflatable member 26 (shown in phantom) of the same type of construction as the inflatable expansible member 16 may be utilized and one or more of these members 26 may be positioned at the foot and/or head of the bed to obtain the same advantages as are obtained from the members 16. Similarly, if desired, a retainer such as 20 may be utilized in order to position the member 26.

Figure 3:
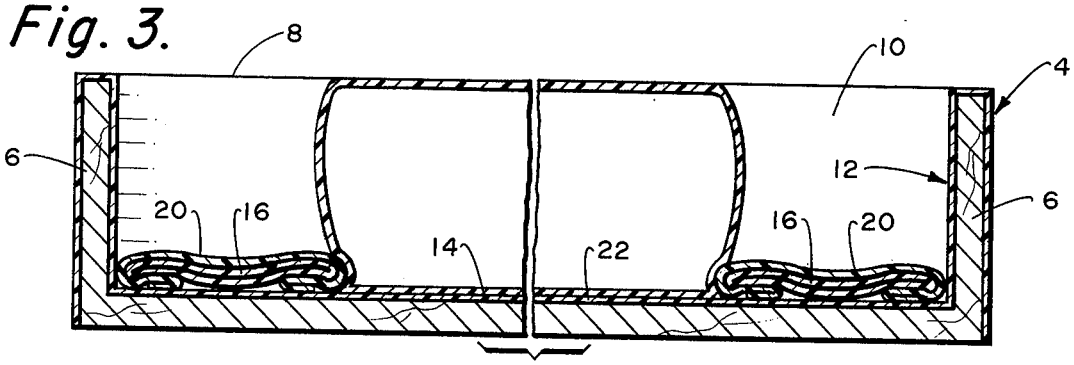
FIG. 3 is a view similar to FIG. 2 but illustrating the water bed structure in the collapsed condition.
Figure 4:
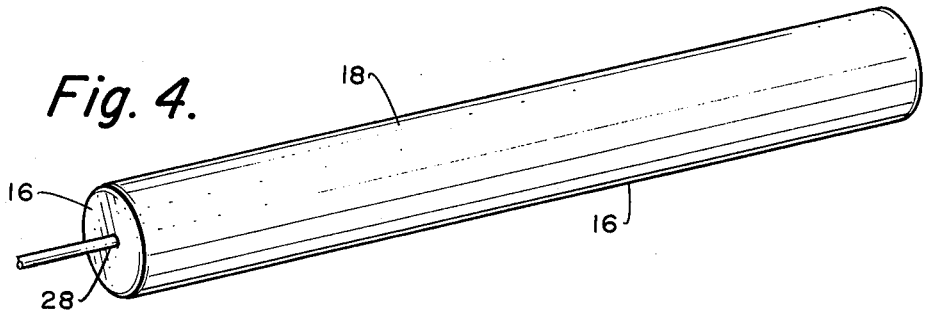
FIG. 4 illustrates an exemplary embodiment of one of the expansible inflatable members utilized in the practice of the invention.

However, for illustrative purposes in depicting the invention and of appreciating the attributes thereof, the invention will be described utilizing the two spaced expansible or inflatable members 16 along the long edges of the rectangular shaped water bed frame 4 as illustrated in FIGS. 1, 2 and 3. The expansible or inflatable members 16 are each provided with a conduit connection 28 which may connect into a common conduit or hose 31 which in turn is connected to an air or fluid supply source 30. It should be understood that the medium used for inflating or filling the expansible member 16 may be liquid such as water, or may be a gas such as air. Obviously, other media would suffice in order to give the substantial rigidity or hardness relative to the remainder of the water bed as alluded to hereinbefore.

The air supply source 30, for example, may comprise a compressor and the like, not shown, to provide an adequate supply of air to sufficiently fill the expansible members 16 to a preselected degree as may be desired by the user of the water bed of the invention. The amount of air, for example, supplied into the expansible members 16 is controlled by control unit 32 suitably positioned adjacent the head of the water bed structure of the invention so that access to same by the user thereof is readily attainable.

Thus, for example, once the water bed has been erected in accordance with the foregoing description, the user selectively fills the expansible members 16 to a sufficient degree of non-resilience or hardness in comparison to the filled water mattress for ease, for example, of entry onto the water mattress. The control unit 32 is precalibrated so as to prevent undue or excess inflation of the expansible members to prevent bursting thereof. Once the user of the device has positioned himself onto the water mattress, another button of the control unit is activated which may, if desired, extract air from the cylinders 16 so as to more readily equalize, for sleeping purposes, the pressure between the water mattress and the inflated expansible members 16. Valving, not shown, may be utilized so as to independently inflate or deflate the expansible members 16 for desired purposes by the user of the water bed and by having a selected range of inflation and deflation of one or both or more of the inflatable expansible members, various degrees of comfort may be obtained from the water bed per se.

In any event, the invention is applicable to existing conventional water beds which may be easily converted in order to obtain the advantages of the invention which allows for ease of getting in and out of bed because of the edge support and also provides means of adjusting by the degree of air or liquid in the expansible members, the degree of firmness of the water mattress. The utilization of the expansible members helps reduce the amount of water or liquid in motion contained within the water mattress; reduces the overall weight of the water bed structure because of less water or fluid being utilized in the water mattress and incidentally, lessens the prospects of bottoming out; allows the water mattress to be filled to a safer level and decreases the amount of electricity or energy usage wherein a water heater is used in conjunction with the water mattress and acts as a tremendous sales aid in converting a prospective water bed user to a water bed because of the ability to selectively control the degree of hardness of two or more lateral edges of the water bed structure. Obviously, the invention also permits easy adaptation of a new user of a water bed to the water bed sleeping concept because in the initial stages, the degree of resiliency of the water bed may be selectively controlled through the amount and degree of inflation or deflation of two or more of the lateral edges of the water bed structure.

While the invention has been specifically described with regard to illustrated embodiments as shown in the figures of the drawing, it is intended that those of ordinary skill in the art will recognize differences and modifications but all such differences and modifications are intended to be included in the appended claims.

We claim:

1. An improved water bed structure comprising the combination:

a. a water bed frame having a four-sided configuration and forming a compartment;

b. at least two spaced apart, separate, independent and distinct, about parallel, expansible members along two opposed lateral edges of said compartment and adapted to be selectively expansible along the depth of said compartment and to form a continuum surface with a separate water mattress, hereinafter defined; and c. an independent and separate water mattress overlying said at least two expansible members and being retained within said compartment.

2. The water bed structure in accordance with claim 1 including a fluid supply means to supply fluid to said at least two spaced apart expansible members.

3. The water bed structure in accordance with claim 2 including control means to control the amount of fluid contained within said at least two spaced apart expansible members.

4. The water bed structure in accordance with claim 3 including a waterproof liner lining the interior of said compartment.

5. The water bed structure in accordance with claim 4 including retaining means for retaining each of said at least two expansible members in fixed position, said retaining means comprises a sleevelike member secured to said waterproof liner.

6. The water bed structure in accordance with claim 5 wherein said waterproof liner is plastic and each of said retaining means comprises a heat sealable sheet form heat sealing engaging said plastic liner.

7. The water bed structure in accordance with claim 6 wherein a reinforcing member encircles each of said expansible members and including an air source comprising an air compressor and control valves operatively connected to each of said at least two expansible members for inflating and deflating same.

8. The water bed structure in accordance with claim 7 wherein said control valves allow for independent, selective expansion or deflation for a selected one of each of said at least two expansible members.

* * * * *